US011975813B1

(12) United States Patent
Løseth

(10) Patent No.: US 11,975,813 B1
(45) Date of Patent: May 7, 2024

(54) LOW CARBON MOBILE MARINE POWER GENERATION SYSTEM

(71) Applicant: Stena Floating Power Infrastructure AS, Oslo (NO)

(72) Inventor: Robert Løseth, Oslo (NO)

(73) Assignee: Stena Floating Power Infrastructure AS, Oslo (NO)

( * ) Notice: Subject to any disclaimer, the term of this patent is extended or adjusted under 35 U.S.C. 154(b) by 0 days.

(21) Appl. No.: 18/416,213

(22) Filed: Jan. 18, 2024

Related U.S. Application Data

(60) Provisional application No. 63/481,321, filed on Jan. 24, 2023.

(51) Int. Cl.
*B63J 3/04* (2006.01)
*B63B 35/44* (2006.01)

(52) U.S. Cl.
CPC ..... *B63J 3/04* (2013.01); *B63B 35/44* (2013.01); *B63B 2035/444* (2013.01); *B63B 2035/4473* (2013.01)

(58) Field of Classification Search
CPC ..... B63J 3/04; B63B 35/44; B63B 2035/444; B63B 2035/4473
See application file for complete search history.

(56) References Cited

U.S. PATENT DOCUMENTS

2017/0341942 A1* 11/2017 Harper, Jr. ..... F01K 7/16

FOREIGN PATENT DOCUMENTS

WO WO-2015008274 A1 * 1/2015 ..... B03B 7/00

* cited by examiner

*Primary Examiner* — S. Joseph Morano
*Assistant Examiner* — Jovon E Hayes
(74) *Attorney, Agent, or Firm* — Haynes and Boone, LLP

(57) ABSTRACT

A system for marine electricity generation and solid carbon production includes an offshore marine platform on which is mounted a regassification system for regassification of liquid methane; a methane splitting system producing solid carbon and gaseous hydrogen; and a power generation system producing electricity and exhaust heat. A first marine vessel is moored adjacent the marine platform for delivery of the liquid methane, and a second marine vessel is moored adjacent the marine platform for removal of the solid carbon produced by the methane splitting system. The hydrogen produced from the methane splitting system is used in a fuel stream for the power generation system. The exhaust heat from the power generation system is utilized in the methane splitting process. Also mounted on the marine platform is a solid carbon handling system disposed to manage the large amount of solid carbon resulting from the methane splitting process.

30 Claims, 7 Drawing Sheets

LOW CARBON MOBILE MARINE POWER GENERATION SYSTEM

PRIORITY CLAIM

This application claims the benefit of priority to U.S. Provisional Application No. 63/481,321, filed Jan. 24, 2023, the benefit of which is claimed and the disclosure of which is incorporated by reference in its entirety.

FIELD OF THE INVENTION

The present disclosure relates to offshore marine power production that minimizes the generation of carbon dioxide, and in particular, an offshore marine platform that utilizes combustion to produce power where solid carbon is a by-product of the process, logistically requiring systems for handling the large quantities of solid carbon generated by the process.

BACKGROUND OF THE INVENTION

While offshore power production systems have been described in the prior art, one drawback to such power production systems is the large amount of carbon dioxide ($CO_2$) that can result from the production of electricity using natural gas, the result of which is the need to capture and dispose of such $CO_2$. Typically, the $CO_2$ is captured utilizing traditional carbon capture technology and transported via a gas pipeline for disposal or further handling. Such handling typically includes $CO_2$ sequestration. More recently, $CO_2$ has been liquified to enhance its portability and the locations where $CO_2$ can be sequestered. In any case, the transport and disposal of carbon dioxide, particularly where it is first liquefied, can be costly, reducing the efficiently of whatever industrial process the $CO_2$ arises from. Thus, there is an ongoing desire to reduce the amount of $CO_2$ resulting from such industrial processes, and hence the need for such $CO_2$ capture, transportation and disposal.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Disclosed herein is a system and method for offshore marine power production that reduces $CO_2$ output when producing offshore power, avoiding the need for $CO_2$ capture and transportation. In particular, an offshore marine platform includes a liquified methane (LM) regassification system and a methane splitting system that splits gaseous methane molecules into hydrogen gas ($H_2$) and solid carbon. The offshore marine platform also includes a power generation system in which a hydrogen rich fuel stream resulting from the methane splitting system is utilized in an internal combustion engine. Finally, the offshore marine platform includes a solid carbon handling system for collecting solid carbon produced from the methane splitting system and delivering the solid carbon to an adjacent solid carbon marine transport vessel for removal. In addition to the solid carbon marine transport vessel moored adjacent the offshore marine platform, a liquid methane floating storage unit may also be moored adjacent the offshore marine platform for receipt of LM from a LM marine transport vessel.

Figure 1:
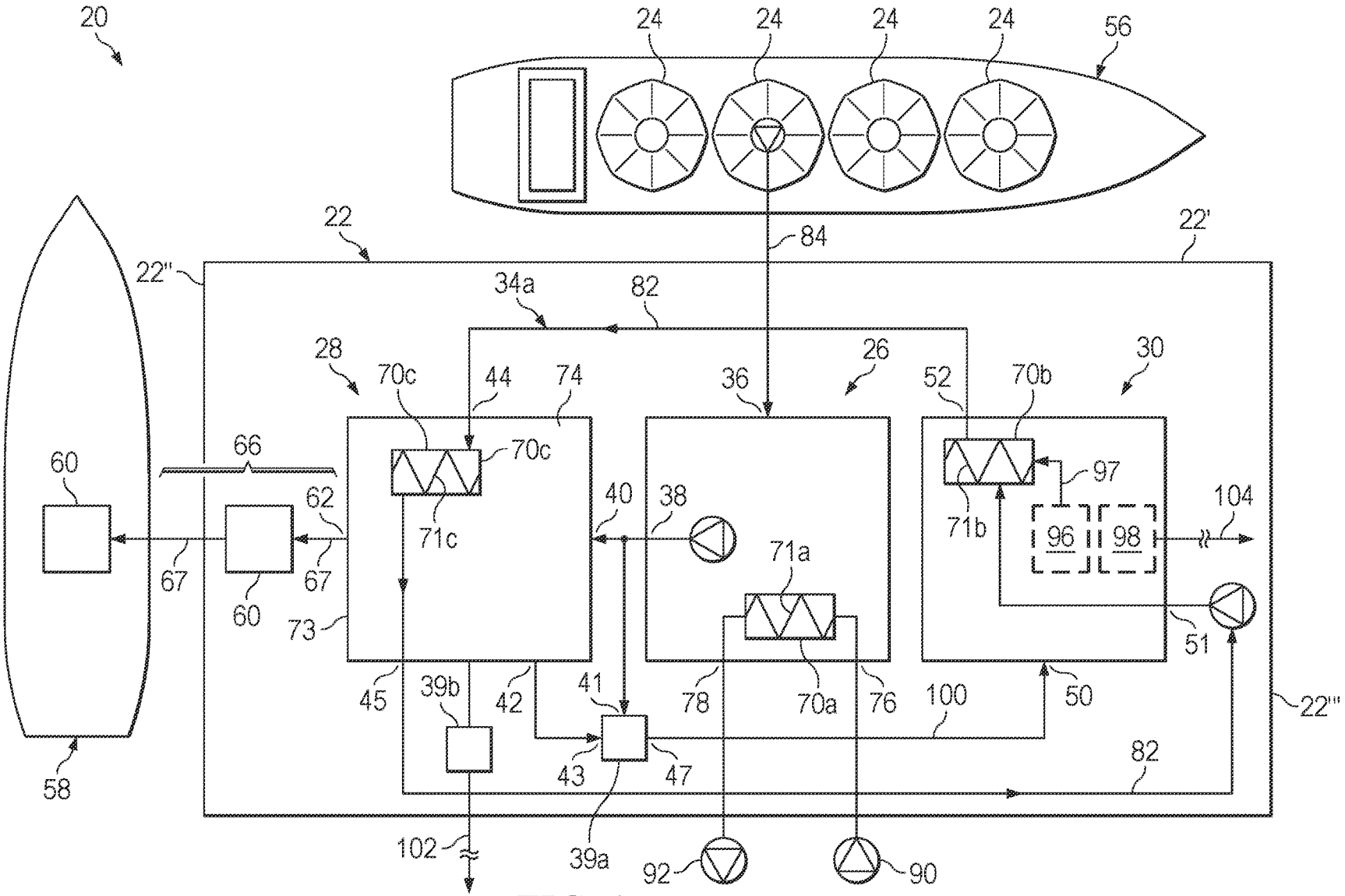
FIG. 1 is a schematic of one embodiment of a marine power production system with reduced $CO_2$ emissions.

With reference to FIG. 1, an offshore power production system 20 is illustrated and includes an offshore marine platform 22. Mounted on the marine platform 22 is a methane splitting system 28 and a power generation system 30, where methane splitting system 28 includes a gaseous methane inlet 40, a hydrogen fuel outlet 42, a working fluid inlet 44, a working fluid outlet 45 and a solid carbon outlet 62. Power generation system 30 likewise includes a hydrogen fuel inlet 50, a working fluid outlet 52 and a working fluid inlet 51, where the working fluid outlet 52 of the power generation system 30 is in fluid communication with the working fluid inlet 44 of the methane splitting system 28 and the working fluid outlet 45 of the methane splitting system 28 is in fluid communication with the working fluid inlet 51 of the power generation system 30. In addition, the hydrogen fuel outlet 42 of the methane splitting system 28 is in fluid communication with the hydrogen fuel inlet 50 of the power generation system 30 via a fuel stream conduit 100. Offshore power production system 20 also includes a regassification system 26, which may be mounted on offshore marine platform 22 or otherwise adjacent offshore marine platform 22. Regassification system 26 is disposed to receive and vaporize a cryogenic hydrocarbon containing methane ($CH_4$), which may include liquid methane (LM), liquified natural gas (LNG) or other mixtures containing methane, to produce a gaseous feed for introduction into the methane splitting system 28. For purposes of this disclosure, references to methane, in either a liquid state or gaseous state, include methane mixtures, such as natural gas. For purposes of this disclosure, "liquid methane" as used herein includes liquified natural gas (LNG) unless otherwise stated. In one or more embodiments, the liquid methane is provided from a methane source 23, which may be one or more liquid methane storage tanks 24, i.e. cryogenic storage tanks, carried on offshore marine platform 22 or otherwise adjacent offshore marine platform 22. In some embodiments, methane source 23 is a floating storage unit 56 moored adjacent offshore marine platform 22 along a first platform side 22' and having liquid methane storage tanks 24. In this regard, regassification system 26 may also be located on the floating storage unit 56 in some embodiments of offshore power production system 20. In any event, regassification system 26 is in fluid communication with the liquid methane storage tanks 24. As such, regassification system 26 has a liquid methane inlet 36 and a gaseous methane outlet 38, where the liquid methane inlet 36 is in fluid communication with the methane source 23 and the gaseous methane outlet 38 is in fluid communication with the gaseous methane inlet 40 of the methane splitting system 28 as described in more detail below. In this embodiment, methane source 23 is a liquid methane source for regassification system 26 and regassification system 26 is a gaseous methane source for methane splitting system 28.

As used herein, "adjacent" means next to, on, or within.

Although not limited to a particular type of vaporizer, in one or more embodiments, regassification system 26 may utilizes the cold energy, also referred to as free energy, of seawater to directly or indirectly vaporize liquid methane. Thus, in some embodiments, regassification system 26 may be an open rack vaporizer (ORV), a shell and tube vaporizer or other heat exchange vaporizer. For example, where liquid methane is in the form of LNG, regassification operations require large amounts of energy in order to heat LNG from its liquid storage temperature of −260° F. (−163° C.) to a gaseous temperature of 40° F. (5° C.). In some embodiments, as part of the regassification process, seawater or energy from power plant cooling water can be used to provide heat in a traditional LNG vaporizer, taking advantage of the temperature difference between the seawater and LNG at −260° F. to warm the LNG to a point where the natural gas is converted from liquid to gas form. This method is particularly desirable because the temperature difference is considered free energy since the temperature of the water is being harnessed for the regasification process as opposed to producing heat from hydrocarbons. Notwithstanding the foregoing, while regassification system 26 may use seawater in some embodiments to produce gaseous methane, in other embodiments, regassification system 26 may utilize other heat sources, such as waste heat from other operations onboard marine platform 22.

Regasification system 26 is shown as having at least a first heat exchanger 70*a* having a heat exchanger interface 71*a* wherein the heat exchange interface is in fluid communication with a working fluid inlet 76 and a working fluid outlet 78 to allow a working fluid (not shown) to pass through heat exchanger interface 71*a*. In one or more embodiments, heat exchanger interface 71*a* may be coils, tubes, tube bundles, plates or the like. In one or more embodiments, the working fluid may be seawater, in which case, working fluid inlet 76 is in fluid communication with a seawater intake 90 and working fluid outlet 78 is in fluid communication with a seawater discharge 92 of marine platform 22. While working fluid is illustrated as seawater in this embodiment, in other embodiments, working fluid may be other substances, such as exhaust gas from combustion processes. In any event, heat exchanger 70*a* will facilitate regasification of liquid methane from methane source 23.

Power generation system 30 incudes one or more internal combustion engines 96 having an effluent outlet 97, where the internal combustion engine 96 is disposed to drive one or more electrical generators 98. In one or more embodiments, the internal combustion engine 96 is a gas turbine. In one or more embodiments, the internal combustion engine 96 is a piston engine. Although internal combustion engine 96 is not limited to a particular type, in some embodiments, gas turbines are desired because the exhaust gas from a gas turbine are typically much hotter than the exhaust gas from a piston engine because of the different combustion processes involved. Because exhaust gas from combustion engine 96 may be utilized to provide heat for use in the methane splitting system 28 in some embodiments, the hotter exhaust gases from a gas turbine may be desired.

As noted above, in one or more embodiments, power generation system 30 may be utilized to provide heat to facilitate operation of methane splitting system 28, and thus power generation system 30 may be in thermal communication with methane splitting system 28. In this regard, power generation system 30 includes a heat exchanger 70*b*, where the working fluid outlet 52 of power generation system 30 is part of heat exchanger 70*b* for heat output and is in fluid communication with the working fluid inlet 44 of the methane splitting system 28. In some embodiments, such thermal communication may be established with a heat transfer circuit 34*a* thermally coupling the power generation system 30 to the methane splitting system 28 via a conduit 82. In heat transfer circuit 34*a*, exhaust from internal combustion engine 96 is directed via the effluent outlet 97 of the internal combustion engine 96 into heat exchanger 70*b* having a heat exchange interface 71*b*, where the exhaust gas from combustion engine 96 is used to heat a working fluid (not shown) passing within the heat exchange interface 71*b*. In one or more embodiments, heat exchange interface 71*b* may be coils, tubes, tube bundles, plates or the like. In one or more embodiments, heat transfer circuit 34*a* is a closed loop system utilizing steam or water as the working fluid within heat transfer circuit 34*a*. The heat exchange interface 71*b* of heat exchanger 70*b* is in fluid communication with working fluid outlet 52, as well as a working fluid inlet 51 to allow the working fluid (not shown) to circulate through heat exchange interface 71*b* for heating by exhaust gas from internal combustion engine(s) 96.

Power generation system 30 is disposed to receive a hydrogen fuel stream that includes gaseous hydrogen ($H_2$) generated from methane splitting system 28 so that the gaseous hydrogen ($H_2$) produced by methane splitting system 28 can be utilized as a fuel in the power generation system 30. As used in this disclosure, "hydrogen fuel stream" combusted in the power generation system 30 may include gaseous hydrogen, as well as any mixture of gaseous hydrogen with other gaseous hydrocarbons, such as unreacted methane, unreacted natural gas or a blend of any of the foregoing with hydrogen.

As illustrated in FIG. 1, in some embodiments, offshore power production system 20 may include a blending unit 39*a* having a gaseous methane inlet 41 in fluid communication with gaseous methane outlet 38 of regassification system 26, a hydrogen fuel inlet 43 in fluid communication with hydrogen fuel outlet 42 of the methane splitting system 28, and a blended fuel outlet 47 in fluid communication with the hydrogen fuel inlet of the power generation system 30, where blending unit 39*a* produces a blended fuel stream of the hydrogen fuel stream and gaseous methane for use as fuel in power generation system 30, it being understood that certain power generation system 30 may not be disposed to combust fuels with high percentages of hydrogen. Thus, in some embodiments, the fuel stream utilized in power generation system 30 comprises primarily hydrogen gas. In some embodiments, the fuel stream utilized in power generation system 30 comprises at least 50% hydrogen gas. In some embodiments, the fuel stream utilized in power generation system 30 comprises at least 75% hydrogen gas. However, in other embodiments, the fuel stream utilized in power generation system 30 comprises a percentage of hydrogen gas that is much lower than the foregoing example, as is known in the art. For example, in some embodiments, blending of hydrogen with natural gas may be limited to no greater than 20% hydrogen to accommodate existing infrastructure. In any event, it will be appreciated that while the fuel stream from methane splitting system 28 may also include $CH_4$, the amount of $CH_4$ in the fuel stream is significantly reduced, which will in turn result in a smaller amount of $CO_2$ when combusted in power generation system 30.

Even where a blending unit 39*a* is not utilized, in one or more embodiments, the amount of $H_2$ resulting from the methane splitting system 28, or conversely, the amount of solid carbon produced, can be controlled so that the fuel stream delivered to the power generation system 30 satisfies predetermined requirements. In this regard, the ability to control the mixture of $CH_4$ and $H_2$ in the fuel stream is of significance in some embodiments since most engines 96, whether gas turbine or internal combustion, are typically not yet certified for burning 100% $H_2$. The typical range of mixtures accepted in industry is 25-75% $H_2$ although increasing with technology development. In one or more embodiments, methane splitting system 28 can be utilized to produce a fuel stream in the range 20-100% $H_2$ content, achieving a proportional $CO_2$ reduction in the exhaust flow from the power generation system 30. In one or more other embodiments, methane splitting system 28 can be utilized to produce a fuel stream containing at least 50% $H_2$.

In one or more embodiments, a hydrogen fuel export conduit 102 extends from the marine platform 22 to a shore-based distribution system (not shown) to remotely distribute at a portion of the hydrogen fuel produced on marine platform 22. As noted above, because pipelines and other infrastructure may not be suited for gaseous fuels with high concentration of hydrogen, in some embodiments, a blending unit 39*b* may be in fluid communication with methane splitting system 28 and regassification system 26 in order to produce a blended fuel stream for transport by export conduit 102. In some embodiments, blending unit 39*b* may be utilized to produce a fuel stream with a concentration of hydrogen that is less than the concentration of hydrogen utilized in the fuel stream provided to power generation system 30, it being more feasible to provide systems, such as combustion engine 96, locally that are disposed for operation with higher concentrations of hydrogen. Thus, in some embodiments, a first blending unit 39*a* may be used to deliver a fuel stream to the power generation system 30, and a second blending unit 39*b* may be used to prepare a fuel stream for export conduit 102, where the fuel streams have different concentrations of hydrogen gas. In some embodiments, the fuel stream from first blending unit 39*a* is disposed to have a higher concentration of hydrogen gas because the onboard internal combustion engines 96 may be more updated than older equipment (not shown) downstream of export conduit 102 that might be unable to operate with higher concentrations of hydrogen.

Methane splitting system 28 is disposed to receive gaseous methane from regassification system 26 and split the gaseous methane into hydrogen gas and solid carbon. As such, in addition to the hydrogen fuel outlet 42 through which produced hydrogen gas is directed to power generation system 30, methane splitting system 28 also includes a solid carbon outlet 62. Notably, as used herein, "splitting" refers to any process where gaseous methane is converted into hydrogen gas and a solid carbon by-product. In one or more embodiments, such methane splitting can be accomplished by methane pyrolysis as represented by the following: $CH_4(g) \rightarrow C(s)+2H_2(g)$. Thus, in one or more embodiments, methane splitting system 28 is a methane pyrolysis system.

In one or more embodiments, methane splitting system 28 includes a reactor 73 with a reaction chamber 74 and a heat source 70*c* disposed to supply heat to reaction chamber 74. In some embodiments, the heat source 70*c* is a heat exchanger disposed within the reaction chamber 74. In some embodiments, the heat source 70*c* is a heat exchanger disposed adjacent the reaction chamber 74. In some embodiments, reactor 73 is a fluidized bed reactor. In some embodiments, heat source 70*c* is a heat exchanger which may form part of heat transfer circuit 34*a*, where heat exchanger 70*c* supplies heat, either directly or indirectly, to reaction chamber 74 of methane splitting system 28 to facilitate a reaction resulting in the breaking of C—H bonds of gaseous methane into gaseous hydrogen and solid carbon. Heat exchanger 70*c* is not limited to a particular arrangement or configuration so long as heat exchanger 70*c* provides heat for the contemplated reaction.

In one or more embodiments, heat exchanger 70*c* may include a heat exchange interface 71*c*. In some embodiments, heat exchange interface 71*c* may be coils, tubes, tube bundles, plates or the like that are in fluid communication with working fluid inlet 44 and working fluid outlet 45 so as to form part of heat transfer circuit 34*a*. In other embodiments, heat transfer circuit 34*a* is an open circuit, whereby steam generated from heat exchanger 70*b* is directly contacted with reactants within methane splitting system 28. In yet other embodiments, heat transfer circuit 34*a* need not include one or both heat exchangers 70*b*, 70*c*, but rather, hot exhaust gas from internal combustion engine 96 is introduced directly into methane splitting system 28 without the need for a heat exchange fluid. In some embodiments where heat transfer circuit 34*a* is an open-loop, heat exchanger 70*c* may be eliminated and steam from heat transfer circuit 34*a* may be introduced directly into reaction chamber 74 for direct contact with gaseous methane. In yet other embodiments, a portion of the exhaust gas from internal combustion engine 96 may be used to generate steam for use in methane splitting system 28 while another portion of the exhaust gas from internal combustion engine 96 may be used directly in reaction chamber 74 of methane splitting system 28.

In other embodiments, the methane splitting system may comprise a plasma pyrolysis system. In other embodiments, the methane splitting system may comprise a fluidised bed system. In other embodiments, the methane splitting system may comprise a moving carbon bed. In other embodiments, the methane splitting system may comprise a molten metal or molten salt system. In other embodiments, the methane splitting system may comprise a pyrolysis system.

It will be appreciated that the power generation system 30 will generate significant waste heat, particularly if utilizing gas turbines, which waste heat is typically carried in the form of effluent or exhaust heat. In one or more embodiments, this exhaust heat from power generation system 30 may be transferred to the methane splitting system 28 via a heat transfer circuit 24*a* that includes a first working fluid circulating through the heat exchangers 70*b* and 70*c*, which first working fluid may be utilized as an input heat source for the energy required for the methane splitting system 28. In some embodiments, as stated above, this first working fluid may be cooling water that is converted to steam by heat exchanger 70*b* utilizing waste heat from engines 96 of the power generation system 30. The first working fluid may then be utilized in a second heat exchanger 70*b* as part of the methane splitting process. In one or more embodiments, the methane splitting process requires heat of at least 600 degrees Celsius, which is commonly an approximate minimum exhaust temperature of gas turbines. In one or more embodiments, the methane splitting process requires heat of at least 100 degrees Celsius, which is commonly an approximate minimum exhaust temperature of other internal combustion engines 96. Thus, in one or more embodiments, such transformation occurs spontaneously at moderate temperatures as described above with no $CO_2$ emissions, via the pyrolysis reaction $CH_4 \rightarrow C+2H_2$. In some embodiments, the turbine exhaust temperatures may be much higher to support other types of methane splitting processes, such as plasma pyrolysis which occurs at 2000° C., fluidized bed which occurs at ~900° C., moving carbon bed which occurs at ~1000-1400° C. or molten metal or molten salt which occurs at ~650-1100° C. On the other hand, high voltage pyrolysis systems can operate at lower temperatures readily achievable with internal combustion engines 96 disposed on marine platform 22

The solid carbon by-product resulting from methane splitting may be carbon deposited on a substrate, plate or catalyst, or otherwise produced as granules, nano-tubes, fibres or the like for industrial uses. In any event, offshore power production system 20 includes a solid carbon handling system 66 in communication with the solid carbon outlet 62 of methane splitting system 28. In one or more embodiments, solid carbon handling system 66 includes a solid carbon storage container 60 and a solid carbon conveyance system 67. In one or more embodiments, solid carbon storage container 60 may be disposed on the platform 22. In one or more other embodiments, solid carbon storage container 60 may be on a solid carbon transport vessel 58 adjacent platform 22. For example, solid carbon transport vessel 58 may be a marine vessel moored adjacent platform 22 along a second side 22", where solid carbon storage container 60 may be one or more ship holds on solid carbon storage container 60. In some embodiments (not shown), floating storage unit 56 may be moored adjacent platform 22 along a third side 22'" that is spaced apart from second side 22"

In one or more embodiments, solid carbon conveyance system 67 may be a conveyor extending between solid carbon outlet 62 and solid carbon storage container 60. In one or more embodiments, solid carbon conveyance system 67 comprises a crane (not shown) and solid carbon storage container 60.

Figure 2:
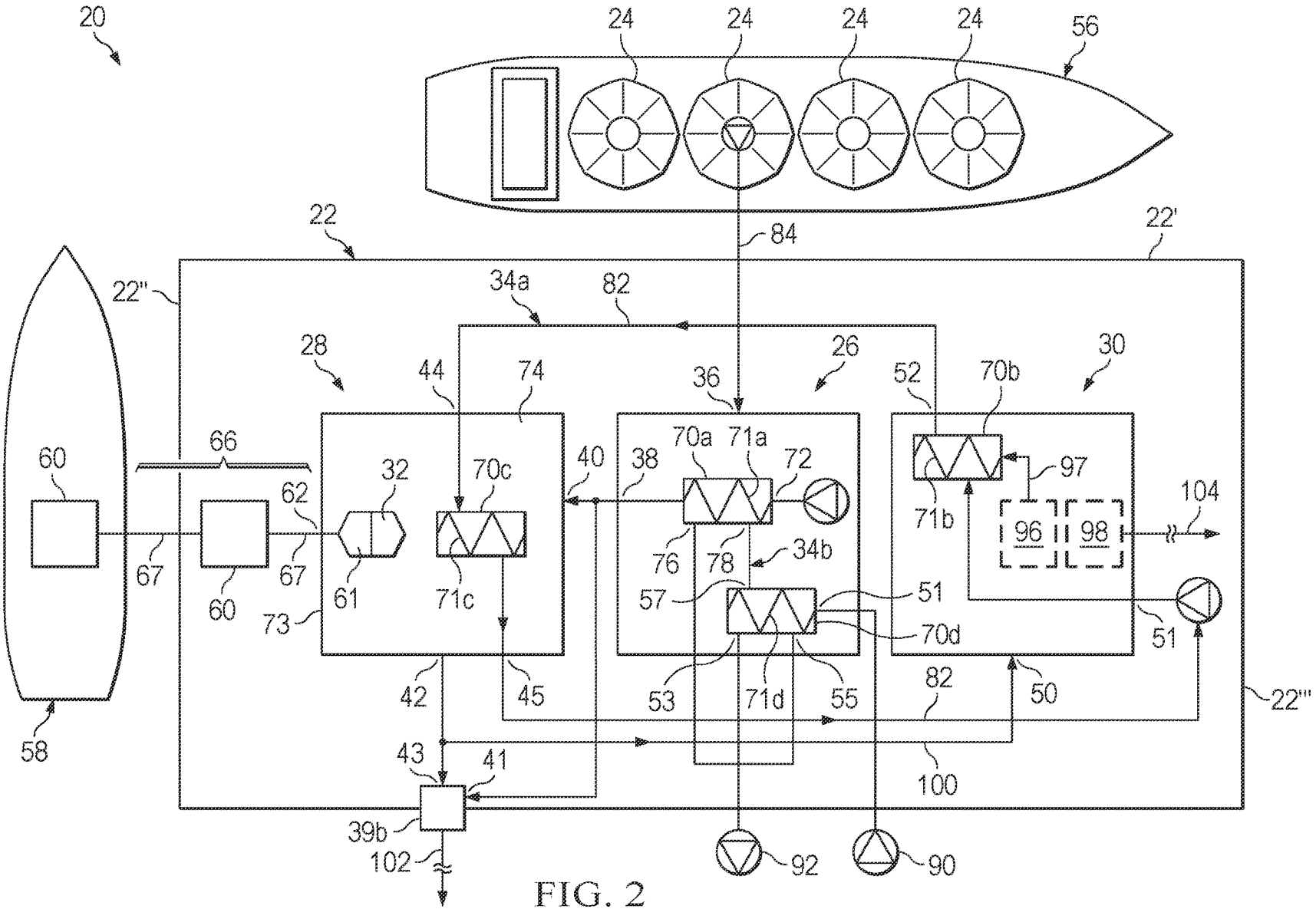
FIG. 2 is a schematic of another embodiment of the marine power production system of FIG. 1.

Offshore power production system 20 shown in FIG. 2 is similar to FIG. 1. Shown in FIG. 2 is an offshore marine platform 22 having a regassification system 26, a methane splitting system 28 and a power generation system 30 wherein the regassification system 26 is disposed to gassify liquid methane. The methane splitting system 28 receives gaseous methane from regassification system 26 and splits methane molecules into gaseous hydrogen and solid carbon. The gaseous hydrogen is then utilized in a fuel stream for combustion by power generation system 30. Heat from the power generation system 30 is utilized to facilitate the methane splitting reaction in the methane splitting system 28.

Liquid methane is provided from a methane source 23, which may be one or more liquid methane storage tanks 24 carried by a floating storage unit 56 moored adjacent offshore marine platform 22.

As described above, a liquid methane inlet 36 of the regasification system 26 is in fluid communication with the liquid methane storage tanks 24 to receive liquid methane for vaporization by the regasification system 26. A gaseous methane outlet 38 of the regasification system 26 is in fluid communication with a gaseous methane inlet 40 of the methane splitting system 28. A gaseous methane outlet 42 of the methane splitting system 28 is in fluid communication with a fuel stream inlet 50 of the power generation system 30 via a fuel stream conduit 100. A heat transfer circuit 34*a* thermally connects the power generation system 30 to the methane splitting system 28. Specifically, a working fluid outlet 52 from the heat exchanger 70*b* of the power generation system 30 is fluidically coupled via a conduit 82 to a working fluid inlet 44 of the heat exchanger 70*c* of the methane splitting system 28. Similarly, a working fluid outlet 45 of the heat exchanger 70*c* is in fluid communication with the working fluid inlet 42 of the heat exchanger 70*b* of the power generation system 30.

Regassification system 26 is shown as having a first heat exchanger 70*a* and a second heat exchanger 70*d*. A process fluid flow loop 34*b* containing an intermediate fluid as the working fluid for regassification fluidically interconnects first heat exchanger 70*a* to second heat exchanger 70*d* to allow the working fluid to flow therebetween. Although the working fluid of process fluid flow loop 34*b* is not limited to a particular fluid, in one or more embodiments, the intermediate fluid may be a mixture of water and glycol, while in other embodiments, the intermediate fluid may be a water ethylene glycol (WEG) mixture. In some embodiments, the working fluid may be water, while in other embodiments, the working fluid may be another heat transfer fluid, such as propane. First heat exchanger 70*a* includes a working fluid inlet 78 and a working fluid outlet 76. Second heat exchanger 70*d* includes a seawater inlet 51, a seawater outlet 53, a working fluid inlet 55 and a working fluid outlet 57. Finally, seawater inlet 51 is in fluid communication with a seawater intake 90 and seawater outlet 53 is in fluid communication with a seawater discharge 92 of marine platform 22.

Although not limited to a particular type of heat exchanger, in one or more embodiments, first heat exchanger 70*a* may be a shell and tube heat exchanger.

Second heat exchanger 70*d* also includes a heat exchange interface 71*d*. While heat exchange interface 71*d* is not limited to a particular heat exchange interface, in some embodiment, heat exchange interface 71*d* is provided to allow seawater to be utilized in the regasification process in order to harness the free energy of the seawater, when conditions permit.

As state above, one by-product of offshore power production system 20 is solid carbon produced from a methane splitting system 28, and hence the need for solid carbon handling system 66 onboard marine platform 22. In this regard, methane splitting system 28 includes a solid carbon collection system 32 for delivery to solid carbon outlet 62. Methane splitting system 28 may produce solid carbon in the form of graphite granules, nano-tubes, carbon fibres or the like (not shown), which are captured by solid carbon collection system 32. In some embodiments, solid carbon collection system 32 may be a substrate on which carbon is deposited, which substrate may include, among others, solid particles, hollow tubes, rods, bars or other structures, preferably coated with a catalysis to facilitate precipitation of solid carbon and disposed within reaction chamber 74 of reactor 73. Although not limited to a particular type of catalyst, such catalyst may include molecule of iron (Fe), or nickel (Ni), cobalt (Co) or platinum (Pt). In one or more other embodiments, solid carbon collection system 32 include a bed of molten metal or molten salt or both within reaction chamber 74 of reactor 73. In this regard, reactor 73 may include a bubble column reactor or a fluidized bed reactor (FBR) into which the gaseous methane is introduced.

It will be appreciated that in some embodiments, the produced solid carbon may need to be refined for commercial use, and thus, methane splitting system 28 may also include a solid carbon refining system 61 to purify the solid carbon for commercial use prior to collection in solid carbon storage containers 60. In other words, the carbon captured by solid carbon collection system 32 may have other impurities, such as metals or salts, that are desirably removed at the time the solid carbon is produced by methane splitting system 28.

In one or more embodiments, to facilitate ready transport of solid carbon to a location remote from marine platform 22, a solid carbon transport 58 may be positioned to receive solid carbon from marine platform 22. In some embodiments, solid carbon transport 58 is a second marine vessel 58 is moored adjacent the marine platform 22, and the second marine vessel 58 includes one or multiple solid carbon storage containers 60 in the form of cargo holds on 60 on second marine vessel 58 for bulk shipment of solid carbon produced on marine platform 22. In other embodiments, solid carbon transport 58 may be a land-based vehicle. Solid carbon handling system 66 may be a conveyor for moving the solid carbon from the solid carbon outlet 62 of methane splitting system 28 to the solid carbon storage containers 60, whether onboard second marine vessel 58, or marine platform 22 or another location. In other embodiments, solid carbon conveyance system 66 may be a crane or other mechanism for manipulation of solid carbon produced by methane splitting system 28. In any event, it will be appreciated that because of the large amount of carbon produced by the pyrolysis process described herein, logistically it is desirable in some embodiments to carry out some or all of the power production process on one or more marine platforms 22 in order to provide a ready means of ship transport for the bulk carbon produced thereon. Typically, approximately 75-80% of the weight of the $CH_4$ becomes solid carbon in the methane pyrolysis process based on the mass weights of carbon and hydrogen. Thus, in one non-liming example, where an LNG carrier delivers 70,000 tons of LNG to marine platform 22 to feed methane splitting system 28, up to 56,000 tons of solid carbon may be produced, requiring collection, handling and transportation. The power production system 20 as described herein provides for the logistics of collection, handling and transportation of such large volumes of solid carbon, and renders the use of marine platform(s) 22 particularly desirable in some embodiments.

Figure 3:
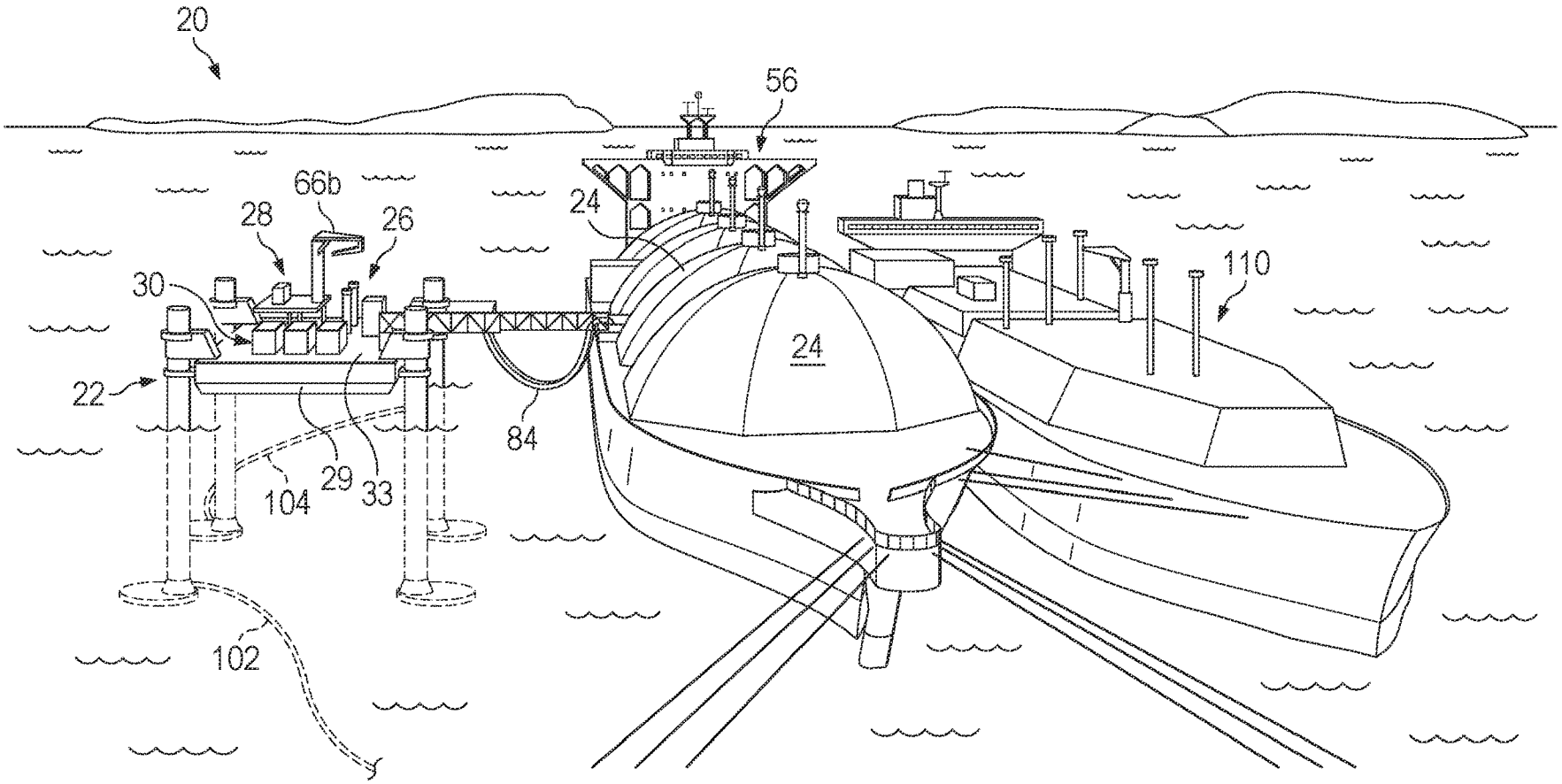
FIG. 3 is a perspective view of a marine power production system.
Figure 4:
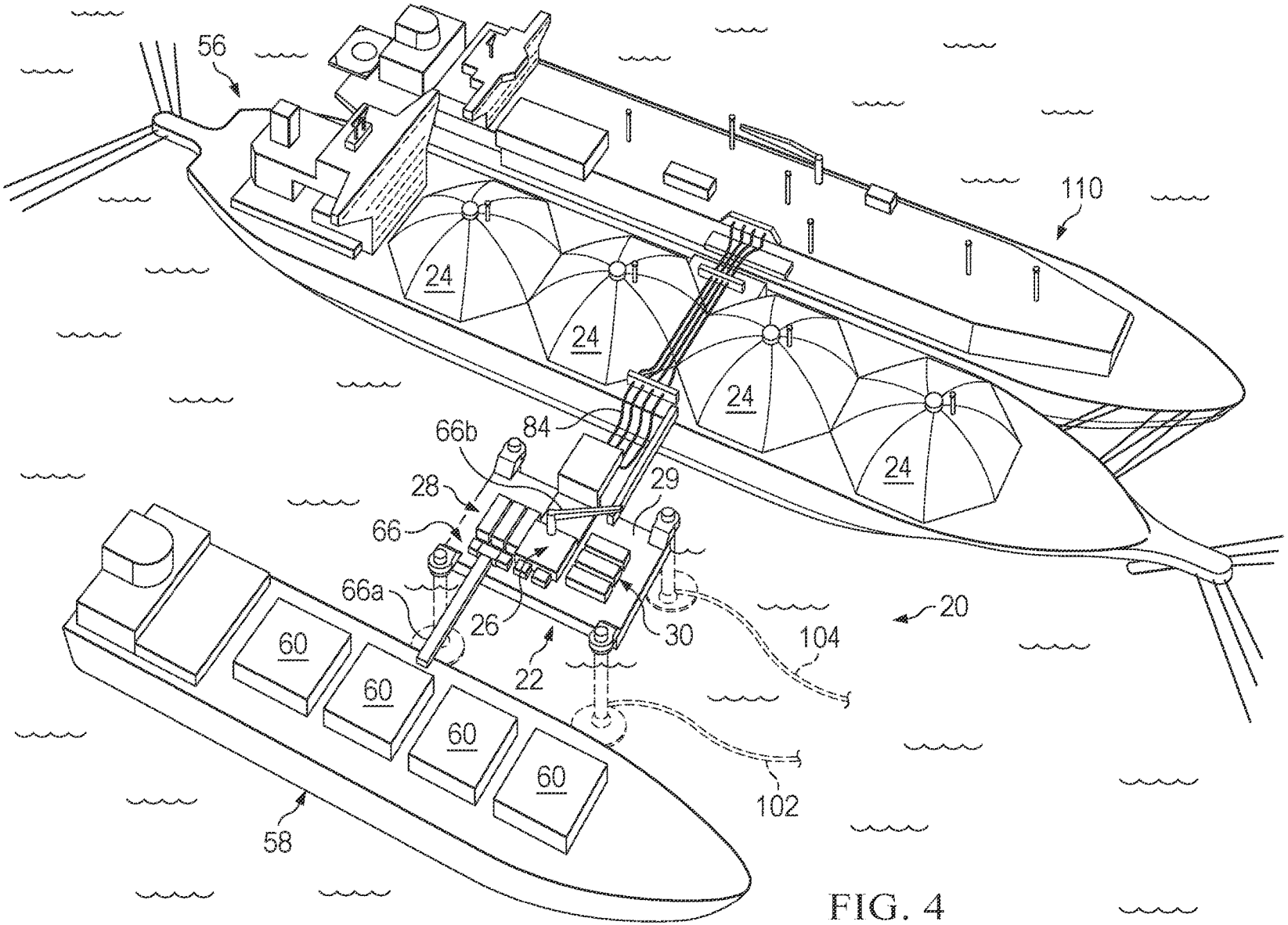
FIG. 4 is a perspective plan view of a marine power production system with a solid carbon transport vessel moored adjacent a marine platform.

Turning to FIGS. 3 and 4, perspective views of offshore power production system 20 are illustrated. Mounted on an offshore marine platform 22 are regassification system 26, a methane splitting system 28 and a power generation system 30. A floating storage unit 56 having liquid methane storage tanks 24 is shown moored adjacent marine platform 22 and disposed to supply liquid methane to regassification system 26 utilizing one or more cryogenic conduits 84 extending from the liquified methane storage vessel 56 to the offshore marine platform 22. A liquid methane supply vessel 110 may be utilized to supply liquid methane to storage tanks 24, whether they are located onboard marine platform 22 or on floating storage unit 56. Also shown moored adjacent offshore marine platform 22 is a solid carbon transport vessel 58 having one or more solid carbon storage containers 60 thereon for receipt of bulk amounts of solid carbon from a methane splitting system 28. With regard to solid carbon produced by methane splitting system 28, marine platform 22 also includes a solid carbon conveyance system 66 to facilitate movement of solid carbon from methane splitting system 28 to solid carbon storage containers or multiple cargo holds 60, whether onboard a solid carbon transport vessel 58, or onboard marine platform 22 or on a land-based vehicle (not shown). In some embodiments, solid carbon conveyance system 66 may include a conveyor 66*a*. In one or more embodiments, one or more conveyors in conveyance system 66 are desirable in order to handle the large amount of carbon produced by methane splitting system 28 as described above. Moreover, a conveyance system 66 utilizing one or more conveyors allows for continuous operation. Notwithstanding the foregoing, in some embodiments, solid carbon conveyance system 66 may include a crane 66*b* for moving bulk amounts of solid carbon.

The marine platform 22 may be mobile marine units or fixed marine platforms, and may include floating or jacked up units, floating vessels or the like. Marine platform 22 may be offshore or nearshore, it being appreciated that in one or more embodiments, the ability to moor a second marine vessel 58 adjacent the marine platform 22 is beneficial, where the second marine vessel 58 has one or more solid carbon storage containers 60 for receiving solid carbon produced by the methane splitting system 28. Moreover, while offshore marine platform 22 is depicted as a single structure, it will be appreciated that offshore marine platform 22 may include multiple separate structures adjacent one another so long as the offshore power production system 20 can be utilized and operated as described herein.

The offshore marine platform 22 may be connected to a power grid (not shown) remote to the offshore marine platform 22 by one or more electrical cables 104 extending away from marine platform 22 for distribution of electricity produced by the power generation system 30, and in particular, by electrical generators 98.

The advantage of the power production system 20 described herein is that when the fuel stream utilizing produced $H_2$ (either alone or in combination with unreacted $CH_4$ or blended $CH_4$) is burned in an internal combustion engine 96 of the power generation system 30, the production of $CO_2$ as an effluent is reduced. The methane splitting system 28 also produces solid carbon as a by-product, either as waste or in form of nano-tubes, carbon fibres, graduals or the like. The amount of solid carbon produced will be substantial as the main weight of the $CH_4$ lies in the carbon part of the $CH_4$ molecule. In this regard, the weight of the solid carbon by-product is typically four times heavier than LNG (liquid cold $CH_4$). For this reason, an efficient logistics solution for handling and removal of the solid carbon from the marine platform 22 also becomes important, as described above. The advantage of the power production system 20 being a marine system is that both the liquified fuel, in form of LNG, and the solid carbon by-product both are typically transported by ship in bulk form, enhancing the logistics efficiency of the overall power production system 20.

Figure 5:
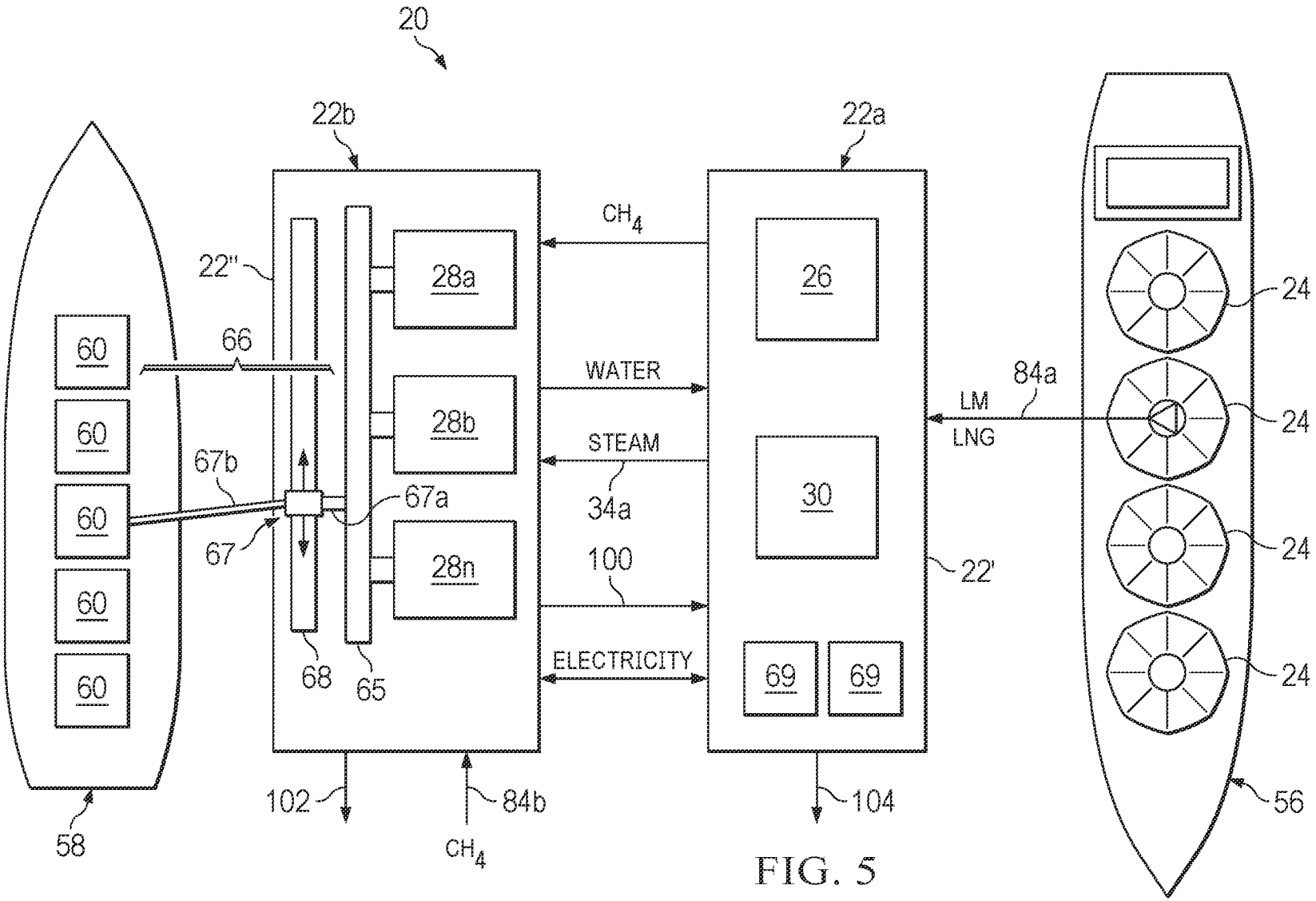
FIG. 5 is a schematic of another embodiment of the marine power production system wherein the methane pyrolysis system that is separate from the power generation system.

FIG. 5 is a schematic of another embodiment of the marine power production system 20 wherein the power generation system 30 is deployed on a first marine platform 22*a*, and the methane pyrolysis system 28 is deployed on a second marine platform 22*b* separate from first marine platform 22*a*. In the illustrated embodiment, first marine platform 22*a* also includes a regassification system 26 for receipt of LNG or LM via a conduit 84*a* from floating storage unit 56 moored adjacent one side 22' of first marine platform 22*a*. In other embodiments, as described above, regassification system 26 alternatively may be deployed on floating storage unit 56. In any event, the liquified hydrocarbon is vaporized and delivered to the second marine platform 22*b* for processing by methane pyrolysis system 28 to produce solid carbon and hydrogen gas. The fuel stream containing hydrogen gas, which fuel stream may also include unreacted methane from the methane pyrolysis system 28 or blended natural gas or blended methane, is delivered by fuel stream conduit 100 back to the first marine platform 22*a* for combustion in power generation system 30 (see also FIG. 1). Moreover, as described also with respect to FIG. 1, a heat transfer circuit 34*a* delivers heat from the power generation system 30 on first marine platform 22*a* to the methane pyrolysis system 28 on second marine platform 22*b*. In one or more embodiments, heat transfer circuit 34*a* includes a working fluid in the form of steam that may be used to deliver heat to the second marine platform 22*b*, and thereafter, the working fluid in the form of water may be returned to first marine platform 22*a* for subsequent heating. Moreover, electricity produced from power generation system 30 may be utilized to provide power to methane pyrolysis system 28. In some embodiments, electricity produced from power generation system 30 may, in addition or the alternative, be exported from marine power production system 20 via one or more conductive cables 104 extending from first marine platform 22*a*.

In one or more embodiments, methane gas may be delivered directly to methane pyrolysis system 28 via a conduit or pipeline 84*b*. In this regard, pipeline 84*b* is a gaseous methane source for methane pyrolysis system 28. Similarly, in one or more embodiments, in addition to the hydrogen gas delivered to power generation system 30, a portion of the hydrogen gas produced by methane pyrolysis system 28 may be exported from marine power production system 20 via one or more conduits 102 extending from second marine platform 22*b*.

Also shown in FIG. 5 is one embodiment of solid carbon handling system 66 disposed on second marine platform 22*b* adjacent methane pyrolysis system 28. In one or more embodiments, solid carbon handling system 66 includes a solid carbon conveyance system 67 to move solid carbon from methane pyrolysis system 28 to one or more solid carbon storage containers 60. In some embodiments, solid carbon conveyance system 67 may include at least one conveyor. In the illustrated embodiment, solid carbon conveyance system 67 includes a first conveyor 67*a* and a second conveyor 67*b*. In some embodiments, first conveyor 67*a* may be a screw or auger conveyor to move solid carbon from a collection trough 65, while second conveyor 67*b* is a belt conveyor. To facilitate conveyance of solid carbon to a plurality of solid carbon storage containers 60, such as those shown on solid carbon transport vessel 58, belt conveyor 67*b* may be elongated stretching away from second marine platform 22*b* and pivotally mounted relative to auger conveyor 67*a*. In one or more embodiments, solid carbon transport vessel 58 is a floating ship or barge moored adjacent a side 22" of second marine platform 22*b*. In some embodiments, side 22" of second marine platform 22*b* is spaced apart from and opposite side 22' of first marine platform 22*a*, allowing floating storage unit 56 and solid carbon transport vessel 58 to be readily moored adjacent their respective marine platforms 22*a*, 22*b* so as to accommodate longer periods of mooring without interfering with the operation of marine power production system 20.

In one or more embodiments, solid carbon conveyance system 67 is slidably mounted on a track 68 disposed on second marine platform 22*b*, to further facilitate handling of solid carbon produced by methane pyrolysis system 28. In this regard, track 68 may be disposed adjacent side 22" of second marine platform 22*b* to permit solid carbon conveyance system 67 to move longitudinally there along.

In the illustrated embodiment, second marine platform 22*b* may include two or more methane pyrolysis system 28*a*, 28*b* . . . 28*n*. In this regard, collection trough 65 forming part of solid carbon handling system 66 may be elongated and communicate with the solid carbon outlet 62 of a plurality of methane pyrolysis systems 28.

Figure 6:
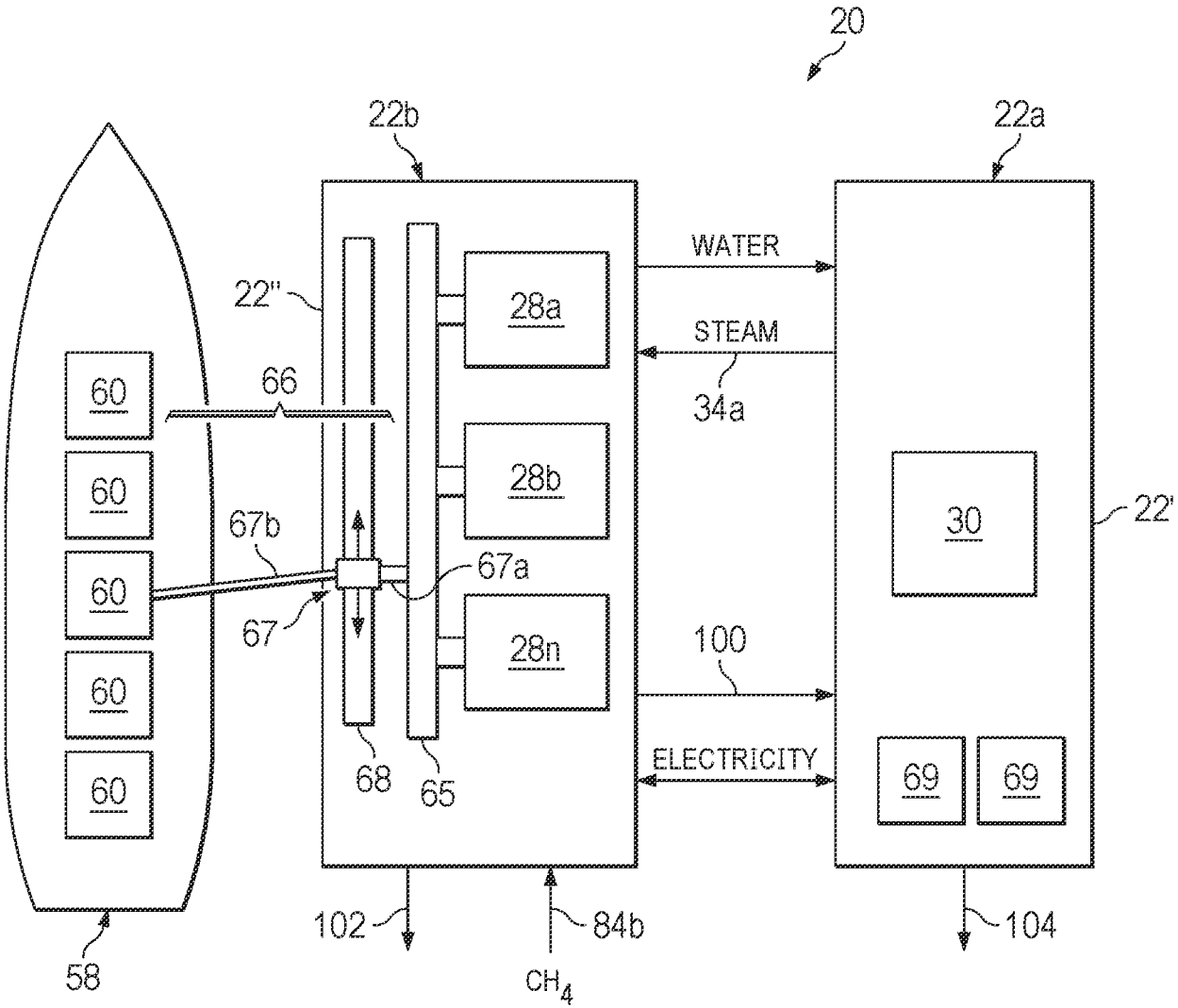
FIG. 6 is a schematic of another embodiment of the offshore marine power production system wherein a near shore marine platform receives methane from a pipeline for the methane pyrolysis system.

The marine power production system 20 shown in FIG. 6 is similar to that shown in FIG. 5, but eliminates the delivery of liquified hydrocarbon, and hence the need for the regasification system 26 of FIG. 5. Rather, in FIG. 6, gaseous methane is delivered to second marine platform 22*b* via a pipeline or conduit 84*b* for processing by methane pyrolysis system 28. Hydrogen produced by methane pyrolysis system 28 is delivered as part of a fuel stream via conduit 100 to power generation system 30 on first marine platform 22*a*. Electricity produced by power generation system 30 may then be exported as illustrated by electrical cable 104 extending away from first marine platform 22*a*. Likewise, a portion of the hydrogen produced by methane pyrolysis system 28 may be exported from second marine platform 22*b* by conduit or pipeline 102.

A floating solid carbon transport vessel 58 is moored adjacent marine platforms 22*b* to facilitate removal and transport of solid carbon to remote locations for further use. The marine power production system 20 of FIG. 6 may be particularly useful for near shore activities where gaseous methane may be delivered to second marine platform 22*b* via a pipeline 84*b* for processing by methane pyrolysis system 28, but where floating solid carbon transport vessel 58 is readily available for removal of the solid carbon once produced. Of course, in the illustrated embodiment, power generation system 30 need not be on a separate marine platform 22*a*, but may be on the same platform 22*b* as methane pyrolysis system 28. However, in one or more embodiments, it is desirable to keep power generation system 30 separate from methane pyrolysis system 28 to avoid interaction of any methane gas with sparks that may result in the distribution of electricity from first marine platform 22*a*. In this regard, first marine platform 22*a* may include one or more step up transformers 69 to facilitate transfer of electricity away from first marine platform 22*a* utilizing electrical cable(s) 104.

With the various embodiments of power production system 20 described above generally contemplate the production of electricity for export away from power production system 20, it will be appreciated that in other embodiments, the arrangement of methane pyrolysis system 28 and power generation system 30 on one or more marine platforms 22 may be utilized simply to treat methane to produce solid carbon, or to produce a hydrogen based fuel stream for export from the marine platform(s) 22. Thus, in some embodiments, the systems may be described as a methane treatment system 20 or a fuel production system 20, depending on the products exported away from the marine platform(s) 22.

Figure 7:
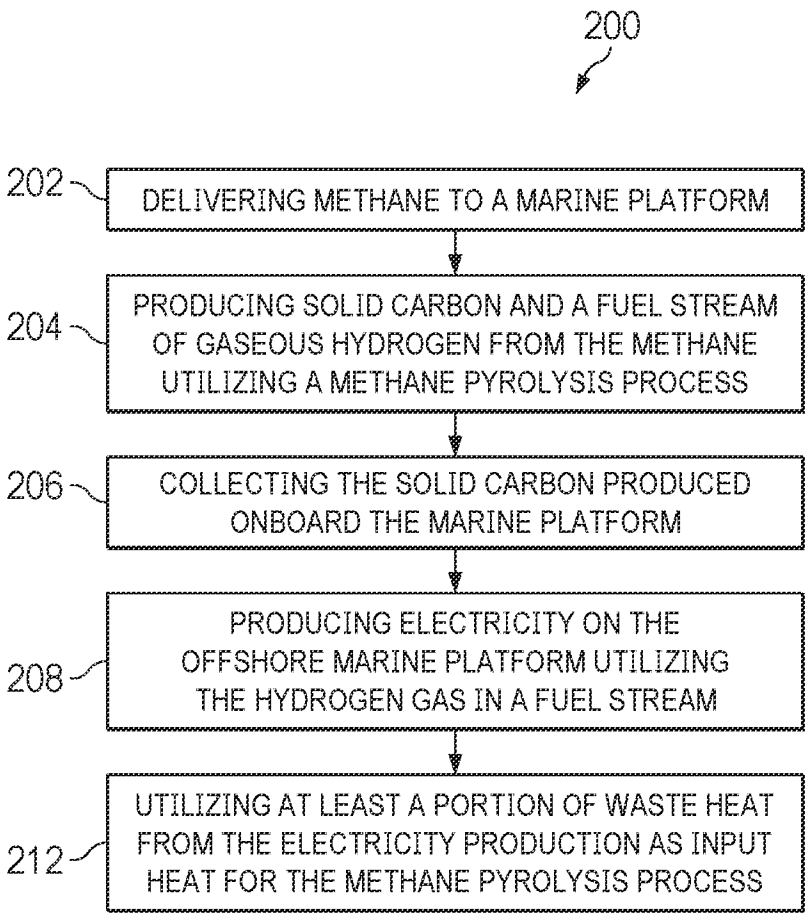
FIG. 7 is a method for offshore marine power production.

FIG. 7 illustrates a method for power production 200. In step 202 of the method of electricity generation 200, methane is delivered to a marine platform. In one or more embodiments, the methane is delivered to the marine platform as gaseous methane via a pipeline in fluid communication with the marine platform. In one or more embodiments, the methane is delivered as liquid methane or liquefied natural gas and converted to gaseous form at the marine platform. Specifically, the cryogenic hydrocarbon, which may be liquid methane or liquified natural gas, is delivered and stored for vaporization to gaseous form at the marine vessel. This regasification process may be carried out onboard the marine platform or onboard an adjacent vessel, such as a floating storage unit moored adjacent the offshore marine platform. In this regard, a floating storage unit moored adjacent the offshore marine platform may be disposed to collect and store larger amounts of liquid methane accumulated at the marine platform from multiple liquid methane supply vessels. Likewise, in one or more embodiments of step 202, liquid methane is delivered to the marine platform and stored locally until ready for regasification. While the regasification process is not limited to a particular system, in one or more embodiments, the cold energy from available seawater adjacent the marine platform may be used for regasification. In some embodiments where the working fluid used for regasification is seawater, the heat from the seawater may be used directly in a heat exchanger for regasification of the liquid methane. In other embodiments, in an effort to avoid freezing of the working fluid in a heat exchanger, an intermediate fluid is utilized as the working fluid, whereby seawater is used to heat the intermediate fluid and then the intermediate fluid, such as a glycol mixture, propane or the like, is used for regasification. In any event, the liquid methane is provided from a source on or adjacent to the marine platform.

In a step 204, solid carbon and a fuel stream of gaseous hydrogen are produced onboard the marine platform from the gaseous methane utilizing methane pyrolysis. The methane pyrolysis may be carried out with various systems onboard the marine platform. In one or more embodiments, methane pyrolysis may be carried out by a plasma pyrolysis system, a fluidized bed system, a moving carbon bed, a molten metal system or molten salt system. In one or more embodiments, the gaseous methane is heated to at least 600 degrees Celsius. In one or more embodiments, the gaseous methane is heated to at least 2000 degrees Celsius. In one or more embodiments, the gaseous methane is heated to at least 900 degrees Celsius. In the case of certain types of "cold" pyrolysis, the gaseous methane is heated to at least 100 degrees Celsius. In one or more embodiments, the gaseous methane is heated to between approximately 100 and 1400 degrees Celsius depending on the pyrolysis process selected. In one or more embodiments, the gaseous methane is heated to between approximately 650 and 1200 degrees Celsius. In one or more embodiments, the gaseous methane is heated to between approximately 100 and 800 degrees Celsius. The methane pyrolysis may be carried out in the reaction chamber 74 of reactor 73. Heat to achieve the reaction temperatures, such as those set out above, are provided by a heat transfer circuit 34*a*. In some embodiments, heat transfer circuit 34*a* utilizes a working fluid, such as steam, to deliver the heat to the reaction chamber 74 to facilitate methane pyrolysis.

In any event, in step 204, hydrogen is produced as a gaseous product of methane pyrolysis. The gaseous product includes hydrogen, but may also include unreacted methane. In one or more embodiments, the methane pyrolysis reaction is altered to adjust the percentage by weight of hydrogen gas in the gaseous product based on the intended downstream use of the gaseous product. In any event, in one or more embodiments, a portion of the gaseous product may be transferred away from the offshore marine platform to a facility remote from the offshore marine platform, such as an onshore facility. In other embodiments, the remote facility may be a distribution pipeline. In other embodiments, the remote facility may be an onshore power generation plant, where the gaseous product may be used to produce electricity onshore (in addition to the electricity produced in step 210 below).

In addition to the gaseous product resulting from methane pyrolysis, solid carbon is also produced by the process of step 204. The solid carbon may be carbon deposited on a substrate, tube, bar, plate or catalyst, or otherwise produced as granules, nanotubes, fibres or the like for industrial uses.

In step 206, the solid carbon from methane pyrolysis is collected and removed from the offshore marine platform. It is anticipated that bulk amounts of solid carbon will be produced by step 204, and thus, a sufficient system for removal will be required. This includes use of a bulk transportation system to transport the solid carbon away from the offshore marine platform. In any event, step 206 may include gathering solid carbon from reaction chamber 74 of reactor 73 and moving the solid carbon to one or more bulk solid carbon storage containers 60 positioned on or adjacent to offshore marine platform 22. In some embodiments, step 206 moves the solid carbon from reactor 73 to carbon storage containers 60 utilizing a conveyor. It will be appreciated that a conveyor may be continuously operating or semi-continuously operating for a period of time to coincide with the production of solid carbon from step 204. In other words, for a period of time when step 204 is being carried out, a conveyor may also be operating to address the large amounts of carbon than may be produced from the process. In other embodiments, a crane may be utilized to move bulk amounts of solid carbon to solid carbon storage containers 60. In some embodiments, the solid carbon storage containers 60 may be carried on transport vessel moored adjacent the offshore marine platform.

In step 208, at least a portion of the gaseous product from methane pyrolysis in step 204 is combusted in an internal combustion engine onboard offshore marine platform. The gaseous product is delivered as a fuel stream to internal combustion engines. In one or more embodiments, the fuel stream comprises at least 50% by volume of hydrogen gas. In one or more embodiments, the fuel stream comprises at 20-75% by volume of hydrogen gas. In one or more embodiments, the fuel stream comprises at least 75% by volume of hydrogen gas. In one or more embodiments, the fuel stream comprises hydrogen gas and methane gas. In one or more embodiments, the fuel stream is limited to no greater than 20% hydrogen. In this regard, in some embodiments, prior to combustion in the internal combustion engine, the gaseous product from methane pyrolysis in step 204 is blended with gaseous methane produced from the regassification step 202 in order to adjust the proportion of hydrogen gas by volume in the fuel stream. In some embodiments, of step 208, the internal combustion engine may be a gas turbine on the offshore marine platform, while in other embodiments, the internal combustion engine may be a piston engine onboard the offshore marine platform and adjacent a methane pyrolysis reactor.

In step 210, the internal combustion engine is utilized to produce electricity. In this regard, the internal combustion engine may be utilized to drive one or more electric generators. The electricity produced in step 210 may then be delivered to a location remote from the offshore marine platform, such an electrical distribution grid.

In step 212, effluent or exhaust resulting from step 208 is utilized to heat the working fluid of heat transfer circuit 34*a*, thereby allowing the waste heat from combustion of the gaseous product to be utilized in the methane pyrolysis step 204. In one or more embodiments, the exhaust is from a gas turbine.

Thus, an offshore power production system has been described herein. In one or more embodiments, the power production system may include a marine platform; a methane source in fluid communication with the marine platform; a methane splitting system mounted on the marine platform and in fluid communication with the methane source; a power generation system mounted on the marine platform and in fluid communication with the methane splitting system; a solid carbon handling system adjacent the marine platform; and a heat transfer circuit thermally coupling the power generation system and the methane splitting system.

In other embodiments, the power production system may include an offshore marine platform; one or more liquid methane storage tanks adjacent the offshore marine platform; a regassification system having a liquid methane inlet and a gaseous methane outlet, the liquid methane inlet in fluid communication with the one or more liquid methane storage tanks; a methane splitting system mounted on the marine platform, the methane splitting system having a gaseous methane inlet, a hydrogen fuel outlet and a working fluid inlet, wherein the gaseous methane inlet is in fluid communication with the gaseous methane outlet of the regassification system; and a power generation system mounted on the marine platform, the power generation system having a hydrogen fuel inlet and a working fluid outlet, wherein the hydrogen fuel inlet is in fluid communication with the hydrogen fuel outlet of the methane splitting system and the working fluid outlet is in fluid communication with the working fluid inlet of the methane splitting system. It yet other embodiments, the power production system may include an marine platform; a first marine vessel moored adjacent the marine platform, the first marine vessel having one or more liquid methane storage tanks; a second marine vessel moored adjacent the marine platform, the second marine vessel having one or more solid carbon storage containers; a regassification system adjacent the marine platform and having a liquid methane inlet and a gaseous methane outlet, the liquid methane inlet in fluid communication with the one or more liquid methane storage tanks; a methane splitting system mounted on the marine platform, the methane splitting system having a gaseous methane inlet, a hydrogen fuel outlet, a solid carbon outlet, and a working fluid inlet, wherein the gaseous methane inlet is in fluid communication with the gaseous methane outlet of the regassification system; a power generation system mounted on the marine platform, the power generation system having a hydrogen fuel inlet and a working fluid outlet, wherein the hydrogen fuel inlet is in fluid communication with the hydrogen fuel outlet of the methane splitting system and the working fluid outlet is in fluid communication with the working fluid inlet of the methane splitting system; and a solid carbon handling system disposed between the solid carbon outlet of the methane splitting system and the solid carbon storage containers of the second marine vessel. It yet other embodiments, the power production system may include a first marine platform; a second marine platform; a gaseous methane source; a methane pyrolysis system mounted on the second marine platform and in fluid communication with the gaseous methane source; a power generation system mounted on the first marine platform and in fluid communication with a hydrogen outlet of the methane pyrolysis system; a heat transfer circuit thermally coupling the power generation system and the methane pyrolysis system; and a solid carbon handling system mounted on the second marine platform adjacent the methane pyrolysis system.

Any of the foregoing power production system may further include, alone or in combination, any of the following:

A solid carbon conveyance system onboard the marine platform and in communication with the solid carbon outlet and the solid carbon storage containers.

A solid carbon storage container disposed on the platform.

The solid carbon storage container is a hold on second vessel.

The solid carbon conveyance system comprises a conveyor belt.

The solid carbon conveyance system comprises a crane and a solid carbon storage container.

The regassification system has a liquid methane inlet and a gaseous methane outlet and cold energy fluid outlet through one or several heat exchangers containing a liquid that transfer heat energy to regasify the liquid methane, and said liquid transferring cold energy in a second set of heat exchangers comprising a closed loop system;

The fuel stream comprises hydrogen gas and gaseous methane.

The fuel stream comprises at least 50% hydrogen gas.

A blending unit in fluid communication with the methane splitting unit and the regasification system.

A blending unit comprising a hydrogen fuel inlet in fluid communication with the hydrogen fuel outlet of the methane splitting system, a gaseous methane inlet in fluid communication with gaseous methane outlet of the regassification system; and a blended fuel outlet in fluid communication with the hydrogen fuel inlet of the power generation system.

The methane splitting system comprises a reaction chamber.

A methane source in fluid communication with the marine platform.

The methane source is a liquid methane source.

The methane source is a gaseous methane source.

The gaseous methane source is a regassification system adjacent the marine platform.

The gaseous methane source is a pipeline in fluid communication with the marine platform.

A liquid methane supply vessel moored adjacent the liquid methane storage vessel.

A liquid methane storage vessel moored adjacent the marine platform.

The bulk shipment system comprises a solid carbon transportation vessel moored adjacent the platform.

The bulk shipment system comprises a bulk storage container.

The regassification system includes a reaction chamber and a heat exchanger disposed adjacent the reaction chamber.

The methane splitting system includes a reaction chamber with a heat exchanger disposed in the reaction chamber.

The heat transfer circuit for the regassification system is a closed loop and comprises a first heat exchanger, a second heat exchanger, conduit fluidically coupling the first heat exchanger to the second heat exchangers, and a working fluid disposed therein, wherein the second heat exchanger has a seawater inlet and a seawater outlet.

The working fluid inlet of methane splitting system is in fluid communication with heat exchanger of power generation system.

The heat outlet of methane splitting system is a working fluid outlet in fluid communication with heat exchanger of the power generation system.

The methane splitting system further includes a heat outlet.

The working fluid is a water-glycol mixture.

The working fluid is liquid propane.

The methane splitting system comprises a plasma pyrolysis system.

The methane splitting system comprises a fluidized bed system.

The methane splitting system comprises a moving carbon bed.

The methane splitting system comprises a molten metal or molten salt system.

The methane splitting system comprises a methane pyrolysis system.

A liquid methane storage vessel moored adjacent the offshore marine platform.

One or more liquid methane storage tanks onboard the offshore marine platform.

A liquid methane storage vessel moored adjacent the offshore marine platform, the liquid methane storage vessel having one or more liquid methane storage tanks onboard the liquid methane storage vessel.

A solid carbon transport vessel moored adjacent the offshore marine platform.

The power generation system comprises one or more internal combustion engines disposed to drive one or more electrical generators.

The internal combustion engine is a gas turbine.

The internal combustion engine is a piston engine.

Cryogenic conduits extending from the liquified methane storage vessel to the offshore marine platform.

The solid carbon transport is a marine vessel moored adjacent the offshore marine vessel. A fuel conduit extending from the hydrogen fuel outlet of the methane splitting system to the hydrogen fuel inlet of the power generation system.

A hydrogen export conduit extending away from the marine platform.

An electrical line extending away from the marine platform.

The process fluid flow loop of the regassification system comprises a first heat exchanger, a second heat exchanger, a conduit fluidically coupling the first heat exchanger to the second heat exchanger, and a working fluid disposed within the conduit.

The working fluid of the process fluid flow loop of the regassification system is a water ethylene glycol (WEG) mixture.

The working fluid of the heat transfer circuit is steam.

The first heat exchanger of the regassification system comprises a heat exchanger interface in fluid communication with a seawater inlet and a seawater outlet.

The first heat exchanger of the regassification system comprises a first heat exchanger interface in fluid communication with a working fluid inlet and a working fluid outlet; and the second heat exchanger of the regassification system comprises a working fluid inlet in fluid communication with the working fluid outlet of the first heat exchanger, a working fluid outlet in fluid communication with the working fluid inlet of the first heat exchanger, and a second heat exchanger interface in fluid communication with a seawater inlet and a seawater outlet.

The heat transfer circuit is a closed loop and comprises a heat transfer fluid, and a heat exchanger of the power generation system in fluid communication with an effluent outlet of the one or more internal combustion engines.

The system of any claim wherein the heat transfer circuit is an open loop and comprises a working fluid and a heat exchanger of the power generation system in fluid communication with an effluent outlet of the one or more internal combustion engines.

The regasification system is mounted on the platform.

The regasification system is mounted adjacent the platform.

The regasification system is mounted on a floating vessel moored adjacent the platform.

The solid carbon handling system comprises a solid carbon conveyor system having a first conveyor and a second convey.

The first conveyor is an auger conveyor, and the second conveyor is a belt conveyor, wherein the auger conveyor is disposed to deliver solid carbon from the methane pyrolysis system to the belt conveyor, and the belt conveyor is disposed to deliver solid carbon from the auger conveyor to a solid carbon storage container.

The belt conveyor is pivotal relative to the screw conveyor.

The belt conveyor is linear.

The screw conveyor is linear.

The solid carbon conveyor system is longitudinally movable along a side of the marine platform.

A plurality of methane pyrolysis systems mounted on the second marine platform.

Likewise, a method for power production has been described. The power production method may include delivering liquified methane to a marine platform and storing the delivered liquified methane adjacent the platform; converting the delivered liquified methane to gaseous methane; splitting the gaseous methane on the offshore marine platform to produce solid carbon and a fuel stream of gaseous hydrogen; utilizing the fuel stream to produce electricity on the offshore marine platform; utilizing at least a portion of waste heat from the electricity production as input heat to the methane splitting process; and collecting the solid carbon for bulk shipment. In one or more other embodiments, the power production method may include mooring a liquified methane vessel adjacent an offshore marine platform; transferring liquified methane from the vessel to the offshore marine platform; converting the transferred liquified methane to gaseous methane; utilizing methane pyrolysis to split the gaseous methane to produce solid carbon and a fuel stream of at least hydrogen gas; combusting at least a portion of the fuel steam in one or more gas turbines on the offshore marine platform to produce electricity and waste heat; utilizing waste heat from the gas turbines in methane pyrolysis process; and transferring solid carbon from the marine platform to a bulk transportation vessel moored adjacent the offshore marine platform. In other embodiments, the method for power production may include regasifying liquid methane to gaseous methane at a marine platform by vaporizing the liquid methane utilizing seawater; utilizing methane pyrolysis to convert the gaseous methane into solid carbon and a gaseous product containing hydrogen; removing the solid carbon from the offshore marine platform; combusting at least a portion of the gaseous product from methane pyrolysis in one or more internal combustion engines onboard the offshore marine platform; utilizing the one or more internal combustion engines to produce electricity and exhaust heat; and utilizing the exhaust heat from the one or more internal combustion engines in the methane pyrolysis step.

Any of the foregoing embodiments of power production method may include alone or in combination, any of the following:

Regassification is carried out onboard the marine platform.

Regasification is carried out adjacent the marine platform.

Delivering liquified methane to the marine platform via a liquid methane supply vessel.

Collecting and storing liquid methane in a floating storage unit moored adjacent the marine platform.

Collecting comprises receiving liquid methane from a plurality of liquid methane supply vessels.

Utilizing seawater to regassify the liquid methane.

Utilizing seawater to vaporize the liquid methane to produce gaseous methane.

Utilizing seawater to transfer heat to an intermediate fluid and thereafter, utilizing the intermediate fluid to vaporize the liquid methane.

The methane pyrolysis is carried out utilizing heat from one or more internal combustion engines.

The methane pyrolysis is carried out utilizing heat from one or more gas turbines.

The one or more internal combustion engines are at least partially fueled by gaseous hydrogen produced by methane pyrolysis.

Heating the gaseous methane to at least 50 degrees Celsius utilizing heat from one or more internal combustion engines.

Heating the gaseous methane to at least 600 degrees Celsius utilizing heat from one or more gas turbines.

Heating the gaseous methane to at least 50 degrees Celsius utilizing heat from one or more gas turbines.

The gaseous product contains hydrogen and unreacted methane.

Altering the methane pyrolysis process to adjust the percentage by weight of hydrogen gas in the gaseous product.

Transferring a first portion of the gaseous product away from the offshore marine platform and utilizing a second portion of the gaseous product onboard the marine platform as a fuel stream for internal combustion engines.

Depositing solid carbon on a substrate during methane pyrolysis.

Utilizing a catalyst to precipitate solid carbon produced during methane pyrolysis.

Utilizing a marine vessel to remove bulk amounts of solid carbon from the offshore marine platform.

Gathering solid carbon from methane pyrolysis reaction chamber and moving the solid carbon to one or more bulk solid carbon storage containers positioned on or adjacent to the offshore marine platform.

Utilizing a conveyor to remove the solid carbon from the marine platform.

Delivering the gaseous product as a fuel stream to one or more internal combustion engines onboard the offshore marine platform.

The fuel stream comprises at least 50% by volume of hydrogen gas.

The fuel stream comprises at 20-75% by volume of hydrogen gas.

The fuel stream comprises hydrogen gas and methane gas.

The fuel stream comprises no more than 20% hydrogen.

Blending the hydrogen gas from methane pyrolysis with gaseous methane to reduce the amount of hydrogen gas by volume in the fuel stream.

Driving one or more electric generators with the one or more internal combustion engines.

Delivering the produced electricity to a location remote from the offshore marine platform.

Transferring the produced electricity away from the marine platform.

Directing the produced electricity to a distribution grid remote from the offshore marine platform.

The exhaust heat is from a gas turbine.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. A power production system comprising:

a marine platform;

a methane source in fluid communication with the marine platform;

a methane splitting system mounted on the marine platform and in fluid communication with the regassification system;

a power generation system mounted on the marine platform and in fluid communication with the methane splitting system;

a solid carbon handling system adjacent the marine platform; and a heat transfer circuit thermally coupling the power generation system and the methane splitting system.

2. The system of claim 1, wherein the methane source is one or more liquid methane storage tanks adjacent the marine platform, the system further comprising a regassification system adjacent the marine platform and in fluid communication with the liquid methane storage tanks and a first marine vessel moored adjacent the marine platform, the one or more liquid methane storage tanks disposed on the first marine vessel.

3. The system of claim 2, wherein the regassification system comprises a first heat exchanger mounted on the marine platform, the first heat exchanger comprising a heat exchanger interface in fluid communication with a seawater inlet and a seawater outlet.

4. The system of claim 2, wherein the regassification system comprises a first heat exchanger mounted on the marine platform and having a first heat exchanger interface, a working fluid inlet and a working fluid outlet; a second heat exchanger mounted on the marine platform and having a second heat exchanger interface, a working fluid inlet, a working fluid outlet, a seater inlet and a seawater outlet, wherein the working fluid inlet of the first heat exchanger is in fluid communication with the working fluid outlet of the second heat exchanger and the working fluid outlet of the first heat exchanger is in fluid communication with the working fluid inlet of the second heat exchanger; a conduit fluidically coupling the first heat exchanger to the second heat exchanger; a working fluid disposed within the conduit.

5. The system of claim 1, wherein the power generation system comprises one or more internal combustion engines having an effluent outlet; one or more electrical generators driven by the one or more internal combustion engines; and a heat exchanger in fluid communication with the effluent outlet.

6. The system of claim 5, wherein the methane splitting system comprises a methane pyrolysis reaction chamber and a heat exchanger disposed adjacent the methane pyrolysis reaction chamber, wherein the heat exchanger of the methane splitting system is in fluid communication with the heat exchanger of the power generation system.

7. The system of claim 6, wherein the methane splitting system comprises a solid carbon collection system comprising a substrate disposed in the a methane pyrolysis reaction chamber.

8. The system of claim 1, wherein the solid carbon handling system comprises a conveyor extending between a solid carbon outlet of the methane splitting system and solid carbon storage container.

9. The system of claim 1, further comprising a blending unit in fluid communication with each of the methane source, the methane splitting system and the power generation system, wherein the blending unit includes a hydrogen fuel inlet in fluid communication with a hydrogen fuel outlet of the methane splitting system, a gaseous methane inlet in fluid communication with a gaseous methane outlet of the regassification system, and a blended fuel outlet in fluid communication with a hydrogen fuel inlet of the power generation system.

10. The system of claim 2, further comprising a first blending unit in fluid communication with each of the regassification system, the methane splitting system and the power generation system, wherein first blending unit includes a hydrogen fuel inlet in fluid communication with a hydrogen fuel outlet of the methane splitting system, a gaseous methane inlet in fluid communication with a gaseous methane outlet of the regassification system, and a blended fuel outlet in fluid communication with a hydrogen fuel inlet of the power generation system; and a second blending unit in fluid communication with each of the regassification system and the methane splitting system, wherein second blending unit includes a hydrogen fuel inlet in fluid communication with a hydrogen fuel outlet of the methane splitting system, a gaseous methane inlet in fluid communication with a gaseous methane outlet of the regassification system, and a blended fuel outlet in fluid communication with a hydrogen fuel export conduit extending away from the marine platform.

11. The system of claim 1, a second marine vessel moored adjacent the marine platform, the second marine vessel having one or more solid carbon storage containers.

12. The system of claim 1, further comprising a hydrogen fuel export conduit extending away from the marine platform and one or more electrical cables extending away from the marine platform.

13. A power production system comprising:

an offshore marine platform;

a first marine vessel moored adjacent the marine platform, the first marine vessel having one or more liquid methane storage tanks;

a second marine vessel moored adjacent the marine platform, the second marine vessel having one or more solid carbon storage containers;

a regassification system adjacent the marine platform and having a liquid methane inlet and a gaseous methane outlet, the liquid methane inlet in fluid communication with the one or more liquid methane storage tanks;

a methane splitting system mounted on the marine platform, the methane splitting system having a gaseous methane inlet, a hydrogen fuel outlet, a solid carbon outlet, and a working fluid inlet, wherein the gaseous methane inlet is in fluid communication with the gaseous methane outlet of the regassification system;

a power generation system mounted on the marine platform, the power generation system having a hydrogen fuel inlet and a working fluid outlet, wherein the hydrogen fuel inlet is in fluid communication with the hydrogen fuel outlet of the methane splitting system and the working fluid outlet is in fluid communication with the working fluid inlet of the methane splitting system; and a solid carbon handling system disposed between the solid carbon outlet of the methane splitting system and the solid carbon storage containers of the second marine vessel.

14. The system of claim 13, wherein the regassification system comprises a first heat exchanger mounted on the marine platform, the first heat exchanger comprising a heat exchanger interface in fluid communication with a seawater inlet and a seawater outlet.

15. The system of claim 13, wherein the regassification system comprises a first heat exchanger mounted on the marine platform and having a first heat exchanger interface, a working fluid inlet and a working fluid outlet; a second heat exchanger mounted on the marine platform and having a second heat exchanger interface, a working fluid inlet, a working fluid outlet, a seater inlet and a seawater outlet, wherein the working fluid inlet of the first heat exchanger is in fluid communication with the working fluid outlet of the second heat exchanger and the working fluid outlet of the first heat exchanger is in fluid communication with the working fluid inlet of the second heat exchanger; a conduit fluidically coupling the first heat exchanger to the second heat exchanger; a working fluid disposed within the conduit.

16. The system of claim 13, wherein the power generation system comprises one or more internal combustion engines having an effluent outlet; one or more electrical generators driven by the one or more internal combustion engines; and a heat exchanger in fluid communication with the effluent outlet.

17. The system of claim 16, wherein the internal combustion engines are gas turbines.

18. The system of claim 13, wherein the methane splitting system comprises a methane pyrolysis reactor with a reaction chamber and a heat source disposed to supply heat to reaction chamber, wherein the heat source is in fluid communication with the a working fluid inlet of the methane splitting system.

19. The system of claim 18, wherein the methane pyrolysis reactor comprises molten metal and molten salt.

20. The system of claim 18, wherein the heat source is a heat exchanger disposed within the reaction chamber.

21. The system of claim 18, wherein the methane splitting system comprises a solid carbon collection system comprising a substrate disposed in the a methane pyrolysis reaction chamber.

22. The system of claim 13, wherein the solid carbon handling system comprises a conveyor extending between a solid carbon outlet of the methane splitting system and solid carbon storage container.

23. The system of claim 13, further comprising a blending unit in fluid communication with each of the regassification system, the methane splitting system and the power generation system, wherein the blending unit includes a hydrogen fuel inlet in fluid communication with a hydrogen fuel outlet of the methane splitting system, a gaseous methane inlet in fluid communication with a gaseous methane outlet of the regassification system, and a blended fuel outlet in fluid communication with a hydrogen fuel inlet of the power generation system.

24. The system of claim 13, further comprising a first blending unit in fluid communication with each of the regassification system, the methane splitting system and the power generation system, wherein first blending unit includes a hydrogen fuel inlet in fluid communication with a hydrogen fuel outlet of the methane splitting system, a gaseous methane inlet in fluid communication with a gaseous methane outlet of the regassification system, and a blended fuel outlet in fluid communication with a hydrogen fuel inlet of the power generation system; and a second blending unit in fluid communication with each of the regassification system and the methane splitting system, wherein second blending unit includes a hydrogen fuel inlet in fluid communication with a hydrogen fuel outlet of the methane splitting system, a gaseous methane inlet in fluid communication with a gaseous methane outlet of the regasification system, and a blended fuel outlet in fluid communication with a hydrogen fuel export conduit extending away from the marine platform.

25. A method for power production comprising:

delivering liquified methane to a marine platform and storing the delivered liquified methane adjacent the platform;

converting the delivered liquified methane to gaseous methane;

producing solid carbon and a fuel stream of gaseous hydrogen from the gaseous methane utilizing a methane pyrolysis process;

producing electricity on the offshore marine platform utilizing the fuel stream;

utilizing at least a portion of waste heat from the electricity production as input heat for the methane pyrolysis process; and collecting the solid carbon produced onboard the marine platform for bulk transport away from the marine platform.

26. The method of claim 25, further comprising blending the fuel stream of gaseous hydrogen with gaseous methane before producing electricity utilizing the fuel stream.

27. The method of claim 25, further comprising blending a portion of the fuel stream of gaseous hydrogen with gaseous methane; and thereafter, directing the blended portion of the fuel stream away from the marine platform.

28. The method of claim 25, wherein collecting comprises conveying the solid carbon to a solid carbon transportation vessel moored adjacent the marine platform.

29. The method of claim 25, wherein utilizing at least a portion of the waste heat comprises combusting at least a portion of the fuel stream in one or more turbines to produce waste heat and electricity; directing the waste heat into a first heat exchanger to heat a working fluid; utilizing the working fluid to provide heat for the methane pyrolysis process.

30. A power production system comprising:

a first marine platform;

a second marine platform;

a gaseous methane source;

a methane pyrolysis system mounted on the second marine platform and in fluid communication with the gaseous methane source;

a power generation system mounted on the first marine platform and in fluid communication with a hydrogen outlet of the methane pyrolysis system;

a heat transfer circuit thermally coupling the power generation system and the methane pyrolysis system; and a solid carbon handling system mounted on the second marine platform adjacent the methane pyrolysis system.

* * * * *